US006523808B1

(12) United States Patent
Lehmann

(10) Patent No.: US 6,523,808 B1
(45) Date of Patent: Feb. 25, 2003

(54) MOUNTING FIXTURE FOR HOLLOW FENCE POSTS

(76) Inventor: Ryan P. Lehmann, 2123 Marietta Ave., Lancaster, PA (US) 17603

( * ) Notice: Subject to any disclaimer, the term of this patent is extended or adjusted under 35 U.S.C. 154(b) by 0 days.

(21) Appl. No.: 09/974,681

(22) Filed: Oct. 11, 2001

(51) Int. Cl.[7] ..... E04H 17/00
(52) U.S. Cl. ..... 256/65.14; 256/65.01
(58) Field of Search ..... 52/298, 296; 256/1, 256/19, 59, 65.01, 65.14; 40/607, 612; 248/530, 156

(56) References Cited

U.S. PATENT DOCUMENTS

| | | | | |
|---|---|---|---|---|
| 3,924,834 A | * | 12/1975 | Young | 256/22 |
| 4,635,905 A | * | 1/1987 | Fontana | 256/65 |
| 4,972,642 A | * | 11/1990 | Strobl, Jr. | 52/297 |
| 5,359,827 A | | 11/1994 | Gehman | 52/698 |
| 5,704,188 A | | 1/1998 | Coulis | 52/736.3 |
| 5,755,431 A | * | 5/1998 | Williams | 256/19 |
| 5,901,525 A | * | 5/1999 | Doeringer et al. | 52/736.4 |

FOREIGN PATENT DOCUMENTS

| | | | |
|---|---|---|---|
| DE | 35 33 282 | * 4/1986 | E04H/17/20 |

* cited by examiner

*Primary Examiner*—Lynne H. Browne
*Assistant Examiner*—Michael P. Ferguson
(74) *Attorney, Agent, or Firm*—Martin Fruitman

(57) ABSTRACT

A fixture attaches a hollow square cross section fence post to a simple vertical pipe. The fixture is constructed as interconnected inner and outer concentric cylinders with the inner cylinder extending beyond one end of the outer cylinder, and holes are formed through the extending portion of the inner cylinder through which fasteners can be attached to a pipe to anchor the fixture. To furnish the required strength, at least four radial fins are used to interconnect the inner and outer cylinders, and plateaus are used around the fastener holes to furnish added thickness to the inner cylinder at those locations.

2 Claims, 2 Drawing Sheets

MOUNTING FIXTURE FOR HOLLOW FENCE POSTS

BACKGROUND OF THE INVENTION

This invention deals generally with fences and more particularly with a fixture for mounting a hollow fence post on a vertical pipe.

Plastic or vinyl fences have become quite common. They are particularly desirable because they are light weight, strong, attractive, and virtually maintenance free. Since the color of such fences is an integral part of the material they need no painting either initially or later in use, and their greatest asset may be the inherent weather resistance of the materials. A plastic structure such as a fence post can be expected to last indefinitely, even in the most severe environment, with no sign of deterioration.

However, to attain the low cost available from such materials as vinyl or other plastics, most fence posts are manufactured as hollow structures, and some sort of fitting is required to attach them to a horizontal base structures such as the earth, concrete pads, or wooden decks. There have been several patents issued on various devices to accomplish the installation of hollow vertical plastic fence posts to such horizontal base structures.

U.S. Pat. No. 5,359,827 to Gehman discloses an open vertical frame structure with a rectangular bottom plate attached to a base structure and angle irons attached to the bottom plate at its corners. A nut atop a threaded central rod is used to force a dished top plate down between the angle irons and force them outward into locking contact with the interior surfaces of a hollow post, thus locking the post in place.

U.S. Pat. No. 5,704,188 to Coulis uses coiled springs which fit tightly around an anchored pipe, with the coiled springs having extensions that fit tightly into the corners of a hollow rectangular post.

U.S. Pat. No. 5,755,431 to Williams discloses a fixture which holds a hollow rectangular post on a stake that has a "T" shaped cross section. The fixture has a generally triangular shape, with outer surfaces extending perpendicularly to an inner web and a central structure constructed to fit over the "T" shape of the stake that is driven into the ground.

Such prior art structures are not only very complex and expensive to fabricate, but also have limited versatility. It would be very desirable to have an easily manufactured, simple device to attach hollow vertical square posts to different base structures.

SUMMARY OF THE INVENTION

The present invention is a mounting fixture to attach a square plastic fence post to a simple pipe, perhaps the most widely used support structure for such fence posts. Pipe is a desirable support structure because it can be cut to any desired length, and it can easily be attached to all of the base surfaces in general use. For a simple earth base, a pipe needs only to be driven into the ground. For a wooden deck, a pipe can be attached by mounting a conventional pipe flange on the surface with screws and threading the pipe into the flange, and for a concrete base, the pipe can be anchored with new concrete set into a hole cut into the concrete base.

The fixture of the preferred embodiment of the invention is basically constructed as two concentric cylinders that are slightly offset longitudinally. The inner cylinder is sized to fit snugly over the pipe which is to be the support for the fence post, and the outer cylinder is dimensioned so that the inner surfaces of the hollow fence post fit tightly over its outer surface.

The two cylinders are attached and spaced apart by at least four fins projecting between them and by a solid surface that spans the space between them at the location of the upper end of the outer cylinder. The use of four spacing fins significantly strengthens the structure over the geometric minimum number of three. It also reduces the circumferential spacing between the fins to accommodate to the four pressure points between the outer surface of the outer cylinder and the inner surface of the square cross section of the fence post held on the outside of the outer cylinder.

The fixture's cylinders are offset along their common axis so that the inner cylinder extends beyond the outer cylinder for access to mounting holes in the inner cylinder for inserting screws to lock the fixture onto the pipe to which it is to be attached.

Other subtle but vital features make the fixture stronger and easier to use. There are small ridges along the inner surface of the inner cylinder to contact the support pipe and prevent irregularities in the pipe from stopping the fixture as it slides along the pipe. Another feature is the addition of thicker sections of the inner cylinder through which the mounting holes penetrate. These thicker sections strengthen the inner cylinder at points where there is particularly high stress. Without the additional strength from the added thickness, the inner cylinder has a tendency to crack when the holding screws are tightened. Another feature is a slight inward taper along the upper portion of the outer surface of the outer cylinder. This taper furnishes the advantage of being able to slide the fence post over the mounting fixture without first exactly centering it.

The mounting fixture of the preferred embodiment thereby furnishes a reliable means for attaching a hollow square fence post to a simple pipe, and the fixture is easily injection molded using a minimum of material.

DETAILED DESCRIPTION OF THE INVENTION

Figure 1:
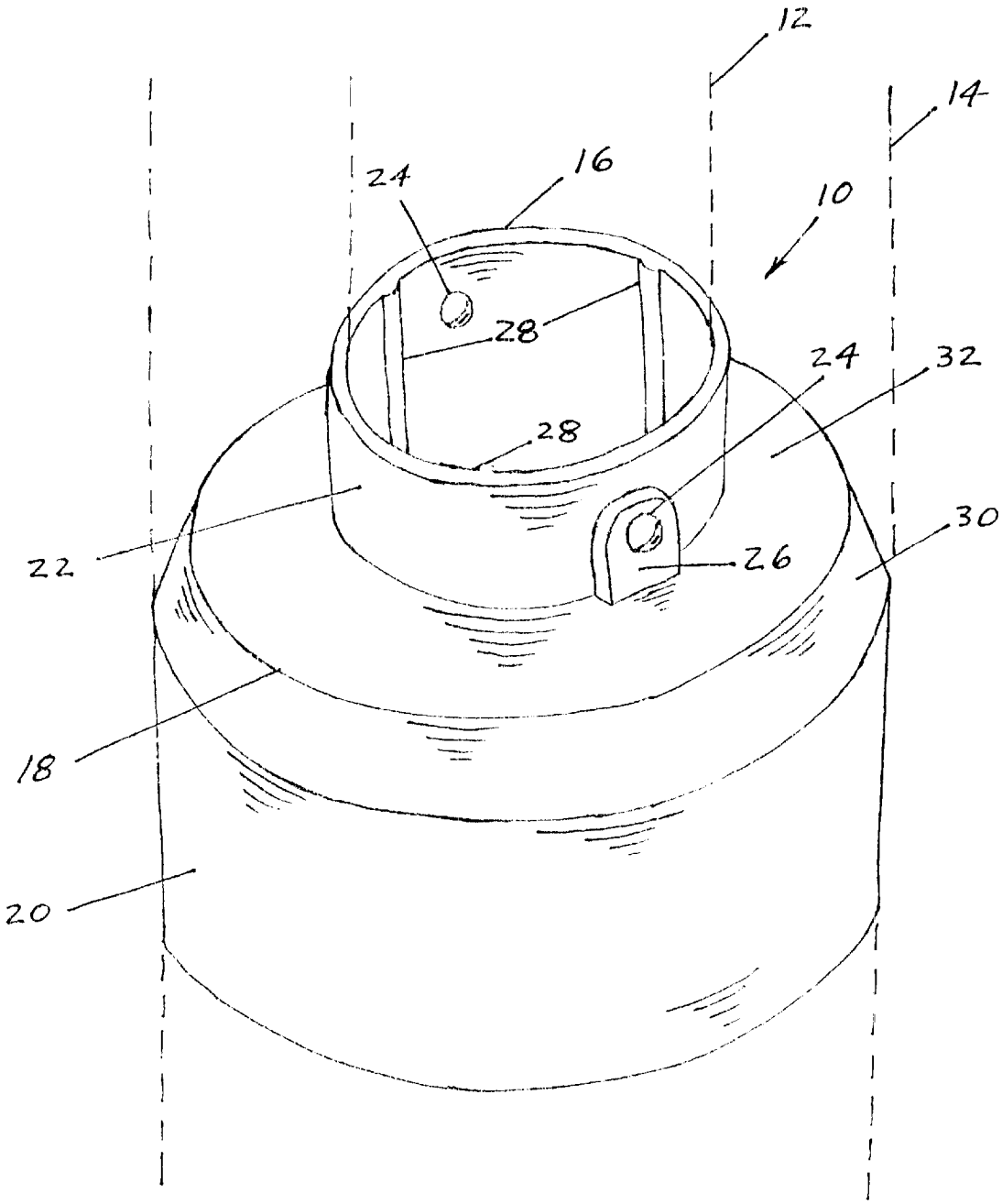
FIG. 1 is a perspective view of the preferred embodiment of the invention with the outside surface of a support pipe and the inside surface of a hollow fence post shown with dashed lines.

FIG. 1 is a perspective view of the preferred embodiment of mounting fixture 10 of the invention with outside surface 12 of a support pipe and inside surface 14 of a hollow fence post shown with dashed lines. Mounting fixture 10 is shown in its usual installed position on a vertical support pipe with inner cylinder 16 extending upward beyond the top end 18 of outer cylinder 20.

Extension 22 of inner cylinder 16 extends beyond top end 18 of outer cylinder 20 so that through mounting holes 24 are easily accessible. For installation of mounting fixture 10 on outside surface 12 of a vertical pipe, screws or some other fasteners (not shown) are fitted into holes 24 and penetrate into surface 12 of the pipe to fix mounting fixture 10 along the length of the pipe. Typically, one mounting fixture 10 is located near the bottom of the vertical pipe, and a second mounting fixture 10 is mounted near the top of the vertical pipe. Depending upon the total length of the pipe used, it may be desirable to use additional mounting fixtures.

Simple pipes are convenient support structures because they can be cut to any desired length, and can easily be attached to most base surfaces. For a simple earth base, a pipe needs only to be driven into the ground. For a wooden deck, a pipe can be attached by mounting a conventional pipe flange on the deck with screws and threading the pipe into the flange, and for a concrete base the pipe can be anchored with new concrete set into a hole cut into the concrete base.

Because screws that penetrate holes 24 into a pipe and are tightened against inner cylinder 16 cause significant stress in inner cylinder 16 and can lead to cracking near holes 14, the region of inner cylinder 16 around holes 24 are formed with integral thicker plateaus 26 (only one of which is visible). Such a structure makes it unnecessary to form entire inner cylinder 16 of thicker material which would cause significantly higher material costs.

Another important feature of mounting fixture 10 is longitudinal inner ridges 28. Inner ridges 28 accommodate mounting fixture 10 to slight irregularities on outer surface 12 of a pipe, and also permit sliding mounting fixture 10 over a pipe that is slightly out of round. Furthermore, ridges 28 reduce the total surface of mounting fixture 10 in actual contact with outer surface 12 of the pipe, thus reducing the friction and permitting mounting fixture 10 to slide more easily over any pipe.

Once at least two mounting fixtures 10 are installed on a vertical pipe, a hollow square cross section fence post with an inner surface 14 can be slid over the mounting fixtures and lowered into contact with the base surface upon which the fence is being installed. This action is greatly facilitated by sloped surface 30 which is formed on mounting fixture 10 between upper end 18 of outer cylinder 20 and the straight cylindrical sides of outer cylinder 20. Because sloped surface 30 is integrated with web 32 attached to inner cylinder 16, when a hollow fence post is lowered onto mounting fixture 10, sloped surface 30 acts to center it on mounting fixture 10 without any special effort.

Figure 2:
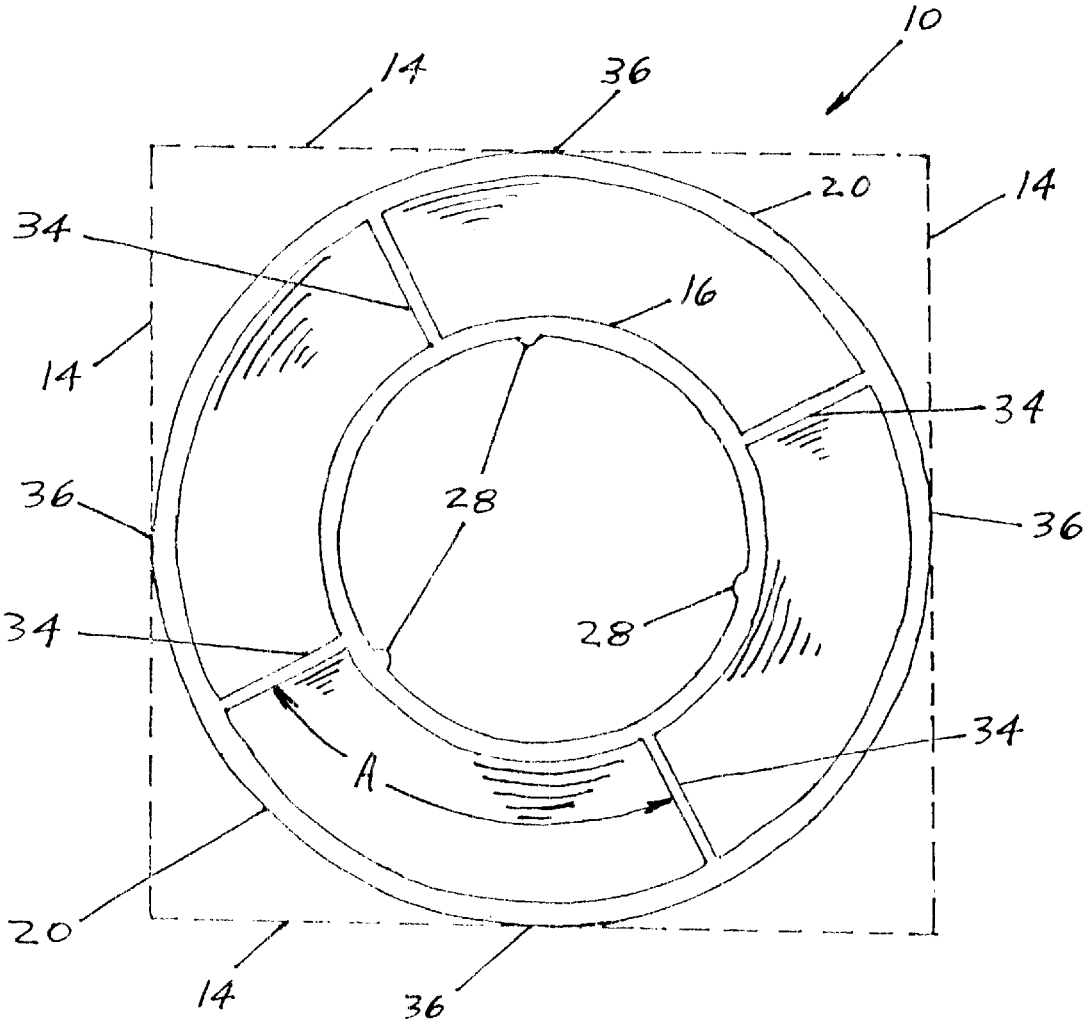
FIG. 2 is a bottom view of the preferred embodiment of the invention showing the inner ridges and the supporting fins.

FIG. 2 is a bottom view of mounting fixture 10 of the preferred embodiment of the invention more clearly showing longitudinal inner ridges 28 and also showing radial supporting fins 34. FIG. 2 also shows the usual position of inner surfaces 14 of a hollow fence post as the fence post is installed on mounting fixture 10.

Mounting fixture 10 includes at least four supporting fins 34 because the use of four spacing fins significantly strengthens the structure over the geometric minimum number of three. It also reduces the circumferential spacing A between the fins to accommodate to the four pressure points 36 between the outer surface of outer cylinder 20 and inner surface 14 of the square cross section of the fence post held on the outside of mounting fixture 10, thus permitting the use of thinner walls for outer cylinder 20.

The preferred embodiment of the mounting fixture of the invention is injection molded from vinyl and has the following approximate dimensions.

Outer cylinder 20 has a wall thickness of 4 mm and has an outer diameter of 95 mm. Its straight cylindrical section is 57 mm long, and its sloped section 30 is 15 mm long. Web 32 is 12 mm wide between the outer surface of inner cylinder 16 and sloped section 30 of outer cylinder 20.

Inner cylinder 16 has a wall thickness of 4 mm and an inner diameter of 45 mm, and extends beyond web 32 by 19 mm.

The spacing between the outer surface of inner cylinder 16 and the inner surface of outer cylinder 20, which is also the length of supporting fins 34, is 15 mm (see FIG. 2), and supporting fins 34 are 2 mm thick.

Mounting holes 24 are 5 mm in diameter, and are located 5 mm above web 32. Thicker plateaus 26 add 2 mm to the thickness of outer cylinder 16 and form a 5 mm boundary around mounting holes 24.

The present invention thereby furnishes a strong, easily manufactured, and utilitarian mounting fixture for hollow square posts, and the mounting fixture has the additional benefit of itself being maintenance free and corrosion resistant.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance, different sizes and materials may, of course, be used for the invention.

What is claimed as new and for which Letters Patent of the United States are desired to be secured is:

1. A fixture for mounting a hollow fence post on a pipe, the fixture comprising:

an outer cylinder with an inner surface, an outer surface, and an axis, the outer cylinder having an outer diameter of a dimension so that the hollow fence post fits around the outer cylinder and is in contact with the outer surface of the outer cylinder;

an inner cylinder with an inner surface and an outer surface, and located on the same axis as the outer cylinder, with the inner cylinder having longitudinal ridges on its inner surface and having an inner diameter of a dimension so that the ridges contact the pipe located within the inner cylinder, and wherein the inner cylinder is located within the outer cylinder so that a portion of the inner cylinder extends beyond one end of the outer cylinder;

at least four radially extending supporting fins connecting the inner cylinder to the outer cylinder;

a web located at the end of the outer cylinder through which the inner cylinder extends with the web connecting the outer cylinder to the outer surface of the inner cylinder;

at least one through hole located in the portion of the inner cylinder which extends beyond the outer cylinder; and a reinforcing plateau forming a boundary around each through hole in the inner cylinder, with the reinforcing plateau integrated into and forming a thicker wall of the inner cylinder around the through hole.

2. The fixture of claim 1 further including a sloped surface at the end of the outer cylinder to join the outer cylinder to the web.

* * * * *